US005918657A

United States Patent [19]

Tuzmen

[11] Patent Number: 5,918,657

[45] Date of Patent: Jul. 6, 1999

[54] HOLELESS WINDOW BLIND

[76] Inventor: Zeki Tuzmen, 11 Wakefield, Irvine, Calif. 92620

[21] Appl. No.: 08/957,830

[22] Filed: Oct. 27, 1997

Related U.S. Application Data

[63] Continuation-in-part of application No. 08/715,127, Sep. 17, 1996, Pat. No. 5,769,140.

[51] Int. Cl.[6] ..... E06B 9/30

[52] U.S. Cl. ..... 160/168.1 R; 160/173 R; 160/177 R; 160/178.3 R

[58] Field of Search ..... 160/173 R, 168.1 R, 160/178.3 R

[56] References Cited

U.S. PATENT DOCUMENTS

| | | | |
|---|---|---|---|
| 2,200,349 | 5/1940 | Walker . | |
| 2,251,363 | 8/1941 | McGrew . | |
| 2,532,617 | 12/1950 | Hauser et al. . | |
| 2,662,593 | 12/1953 | Walker . | |
| 2,728,108 | 12/1955 | Schlegel, Jr. . | |
| 2,757,727 | 8/1956 | Findell . | |
| 2,796,927 | 6/1957 | Evans . | |
| 3,086,586 | 4/1963 | Wolfe . | |
| 3,916,973 | 11/1975 | Schuppler et al. | 160/178.3 R |
| 3,971,427 | 7/1976 | Coldewey et al. . | |
| 4,154,281 | 5/1979 | Schluep | 160/178.3 R |
| 4,236,567 | 12/1980 | Frentzel . | |
| 4,377,194 | 3/1983 | Tsuhanko . | |
| 4,530,390 | 7/1985 | Schluep et al. . | |
| 4,763,713 | 8/1988 | Kraus . | |
| 4,951,729 | 8/1990 | Chi Yu | 160/178.3 R |
| 5,386,867 | 2/1995 | Chen . | |
| 5,465,775 | 11/1995 | Biba et al. . | |
| 5,582,226 | 12/1996 | Voss et al. | 160/178.3 R X |
| 5,597,027 | 1/1997 | Simon et al. . | |
| 5,727,613 | 3/1998 | Judkins | 160/178.3 R |
| 5,743,319 | 4/1998 | Christopherson | 160/173 R |
| 5,769,140 | 6/1998 | Tuzmen | 160/168.1 R |

FOREIGN PATENT DOCUMENTS

| | | |
|---|---|---|
| 12687 | 7/1903 | Austria . |
| 3414354 | 10/1985 | Germany . |

*Primary Examiner*—Daniel P. Stodola
*Assistant Examiner*—Bruce A. Lev
*Attorney, Agent, or Firm*—Wallenstein & Wagner, Ltd.

[57] ABSTRACT

A window blind (10) has a headrail (12) housing a tilt assembly (18) and a plurality of slats (14) having opposed external longitudinal edges (36). The blind (10) has a sleeve (28) extending from the tilt assembly (18) to a bottommost slat (14) along the external longitudinal edges (36) of each slat (14). Each slat (14) has a clip (38) that engages the external longitudinal edges (36) of each slat (14). A loop (40) is positioned around the clip (38) and through a pair of openings (48) in the sleeve (28) to connect the sleeve (28) to the each slat (14). A lift cord (30) extends from the headrail (12) to the bottommost slat (14) along the external longitudinal edge (36) of each slat (14) where it is connected to the bottommost slat (14). The lift cord (30) is within the sleeve (28). In another embodiment, a blind (10') utilizes a modified tilt/lift mechanism (16') which comprises a tilt cord (50) which extends from the tilt assembly (18) in the headrail (12) to the bottommost rail adjacent an external longitudinal edge (36) of the slats (14) and a lift cord (30) which extends to the bottommost rail adjacent an external longitudinal edge (36) of the slats (14) and proximate the tilt cord (50). A tilt loop (56) extends from the tilt cord (50) and cooperates with the clip (38) connected to the slats (14) for rotatably opening and closing the plurality of slats (14). A lift cord loop (62) proximate the tilt loop (56) also extends from the tilt cord (50) to contain the lift cord (30).

16 Claims, 4 Drawing Sheets

HOLELESS WINDOW BLIND

DESCRIPTION

This is a continuation-in-part application of application Ser. No. 08/715,127, filed Sep. 17, 1996, now U.S. Pat. No. 5,769,140.

TECHNICAL FIELD

The present invention relates generally to window blinds, and more particularly to a holeless window blind having an improved tilt/lift mechanism.

BACKGROUND OF THE INVENTION

Window blinds having a plurality of equally spaced, parallel, horizontal slats are well-known and are oftentimes referred to as venetian blinds. In these conventional blinds, the individual slats are supported by a pair of ladder tapes having cross-members, sometimes referred to as ladder cords, extending therebetween. In addition, lift cords extend down from a headrail, or valance, through holes in the center of each slat, to a bottom rail. The lift cords are used to adjust the height of the window blind.

There are a number of disadvantages in these conventional window blinds. The use of ladder cords to support the slats unduly increases the stack height of the window blind when the blind is raised to its uppermost position. A small stack height is desirable to maximize the open area of a window when the blind is raised to its uppermost position. The use of ladder cords also hinders the complete tilting and, thus, complete closure of the slats. By routing the lift cords through holes in the slats, privacy is limited because, like the ladder cords, the lift cords hinder the complete tilting and thus, complete closure of the slats as well. In addition, even when the slats are closed, some light can still pass through the slats because of the holes. Finally, with the lift cords passing through each slat, the individual slats cannot be removed from the blind for cleaning, repair or replacement.

U.S. Pat. No. 3,916,973 discloses a blind assembly employing braided tilt cords which extend on the outside of the slats. Flexible loop-shaped attachments extend out of the cord and connect to securing devices on the slats. However, this device also employs a central opening in the slat for a pull cord. As such, this device does not allow for removal of the slats.

Other blinds have been designed having removable slats for cleaning and repair. For example, U.S. Pat. No. 3,086,586 discloses a blind with slats having contoured slots. Upon assembly, the lift cords are inserted into the slats via the contoured slots. To remove the slat from the blind, the lift cords are simply removed from the slat via the contoured slots. U.S. Pat. No. 2,662,593 discloses a blind that eliminates slots in the slats but adds notches on the sides of the slats in order to attach a rigid wire clip to the slats. The rigid wire clip is required to retain the slats to the ladder cords. U.S. Pat. No. 2,532,617 also discloses a blind that eliminates slots in the slats. This blind, however, employs ladder cords and compound clips to retain the slats to the ladder cords. Although these blinds allow for slat removal, the blinds still suffer from increased stack height, incomplete closure of the slats, and light passage through the holes, or slots in the slats. Furthermore, these blinds are complex and costly.

SUMMARY OF THE INVENTION

A blind assembly in accordance with the present invention eliminates the drawbacks and difficulties of the conventional blind assemblies described above.

According to a first aspect of the invention, a window blind is disclosed having a headrail, housing a tilt assembly, and a plurality of slats. The slats have opposed external longitudinal edges. The blind further has a sleeve extending from the tilt assembly to a bottommost slat along at least one external longitudinal edge of each slat. A means is provided for connecting the sleeve to each slat. The blind also has a lift cord within the sleeve, extending from the headrail to the bottommost slat where it is connected to the bottommost slat. The slats are solid members having no holes, and can be individually removed from the blind for cleaning, repair or replacement. As each slat is individually removable, the blind assembly need not be disassembled to remove any one or more slats.

According to another aspect of the invention, a clip and a loop are provided for each slat to connect the sleeve to the slats. The clip engages an external longitudinal edge of the slat and the loop cooperates with the clip and the sleeve.

According to another aspect of the invention, the headrail houses a clutch proximate a front portion of the headrail. The lift cords enter the front of the headrail and extend to the clutch along an axis substantially parallel to a longitudinal axis of the headrail.

According to another aspect of the invention, a modified tilt/lift mechanism is utilized which comprises a tilt cord and a lift cord. The tilt cord extends from the tilt assembly in the headrail to a bottommost rail adjacent an external longitudinal edge of the slats. The lift cord extends from the headrail to the bottommost slat adjacent an external longitudinal edge of the slats and proximate the tilt cord. A tilt loop extends from the tilt cord and cooperates with a clip which is connected to the slats. A lift cord loop proximate the tilt loop connected to the clip also extends from the tilt cord to contain the lift cord.

Other advantages and aspects of the present invention will become apparent upon reading the following description of the drawings and detailed description of the invention.

DETAILED DESCRIPTION

Figure 1:
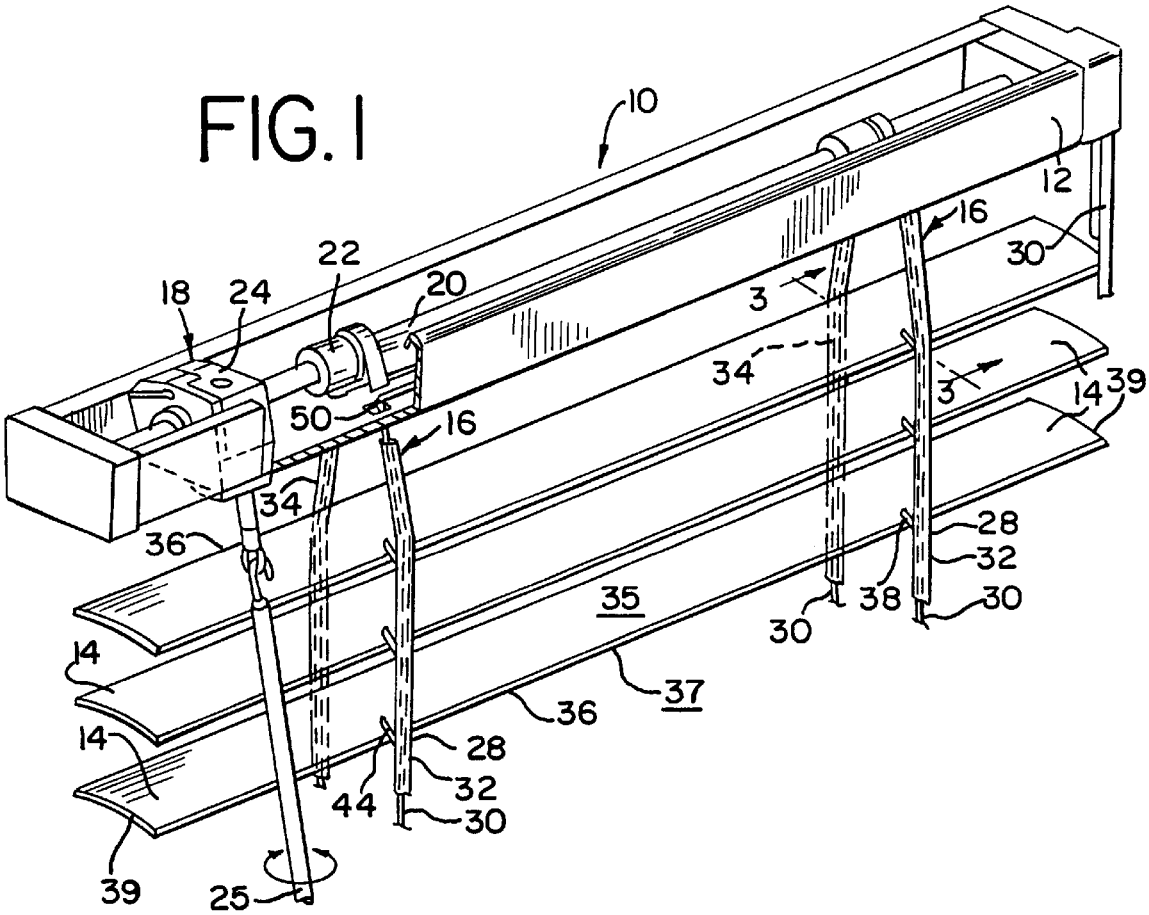
FIG. 1 is a partial perspective view of the window blind of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Referring to the drawings, FIG. 1 shows a window blind 10 of the present invention. The blind 10 generally includes a headrail 12, or valance, a plurality of slats 14, and a tilt/lift mechanism 16.

Figure 2:
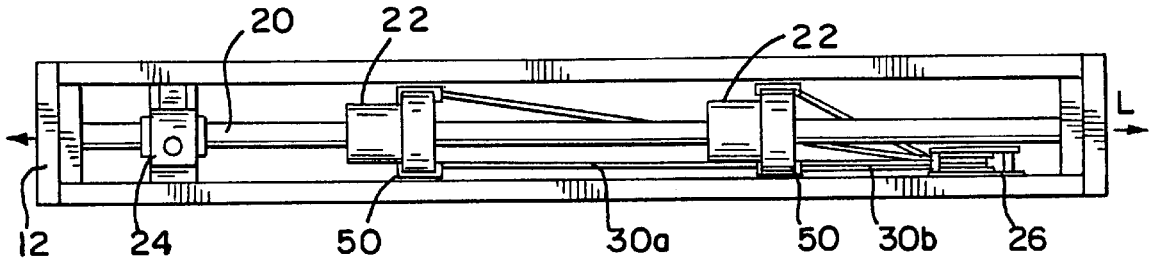
FIG. 2 is a top plan view of a headrail of the window blind of FIG. 1 showing a tilt assembly and a lift cord clutch.

The headrail 12 is secured above a window frame (not shown) in any conventional manner such as by screws or nails. It is understood that the present invention could also be used in doorways or other openings requiring blinds. As shown in FIGS. 1 and 2, the headrail 12 houses certain mechanical devices used to operate the blind 10. For instance, a tilt assembly 18 is housed with the headrail 12. The tilt assembly 18 includes a shaft 20 with rollers 22 and a gear mechanism 24. The shaft 20 is positioned longitudinally within the headrail 12 and cooperates with the gear mechanism 24 to tilt the blind 10. This will be described in greater detail below. A lift cord clutch 26 is also housed in the headrail 12 to cooperate with lift cords to vary the height of the blind 10.

FIG. 1 also shows the plurality of slats 14 included in the window blind 10. The number of slats 14 utilized will vary depending on the vertical size of the window or opening. Each slat 14 has a generally uniform size and rectangular shape. The slats 14 are solid and have no holes, apertures, slots, notches or other perforations. Thus, the slats 14 have uniform strength throughout their entire length and are not subject to undue creasing, bending or other deformation. Generally, as shown in FIG. 1, each slat 14 has a pair of opposed external longitudinal edges 36, a top and bottom surface 35,37 (best seen in FIG. 4) and ends 39. The slats 14 can be constructed of a number of different materials such as wood, metal, plastic, aluminum or other rigid material. The lowermost slat of the blind is typically referred to as a bottom rail (not shown). The bottom rail can be a standard slat, but it is usually a thicker, heavier slat. A heavier slat is used as a bottom rail to maintain the straight vertical shape of the opened blind when wind passes through an open window thus blowing through the plurality of slats of the blind 10.

Figure 3:
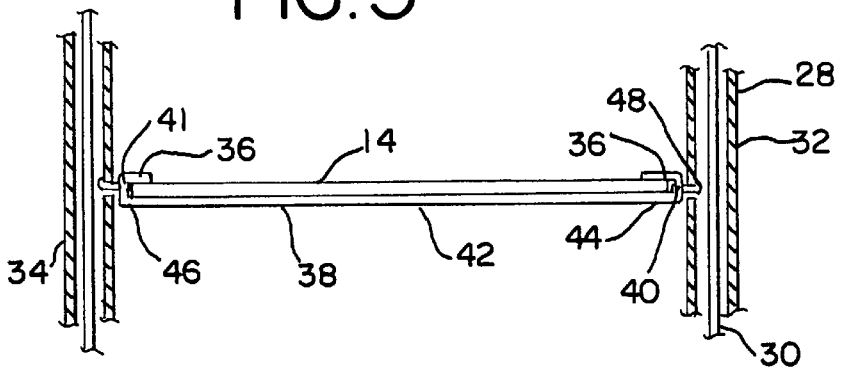
FIG. 3 is a partial cross-sectional view taken along Line 3—3 in FIG. 1 showing a tilt/lift mechanism of the present invention.
Figure 4:
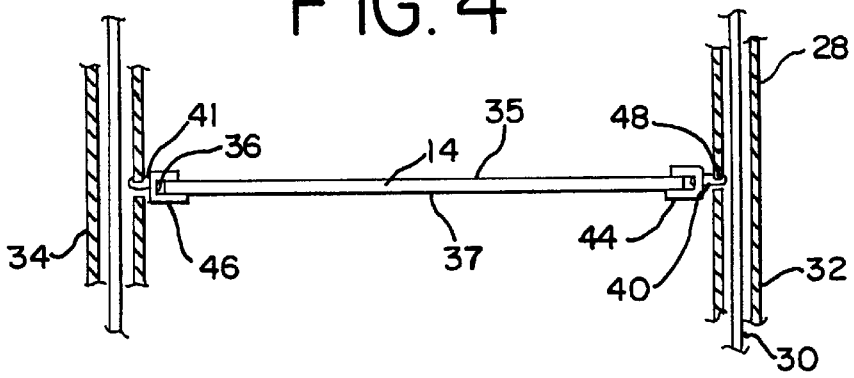
FIG. 4 is a partial cross-sectional view also taken along Line 3—3 in FIG. 1 showing an alternative embodiment of the tilt/lift mechanism; and, FIG. 5 is an enlarged partial cross-sectional view showing a connection between a sleeve and slat of the window blind of FIG. 1.

FIGS. 1, 3 and 4 show the tilt/lift mechanism 16 of the present invention. As shown in FIG. 1, a pair of tilt/lift mechanisms 16 are included, one on each end of the blind 10. Depending on the size of the window blind, more tilt/lift mechanisms 16 could also be utilized. Also, a single tilt/lift mechanism 16 could be utilized with smaller blinds. In the preferred embodiment, however, a tilt/lift mechanism 16 is included on each end of the blind 10. The structure of one of the tilt/lift mechanisms 16 will be described in detail with the understanding that the other mechanism has similar structure.

The tilt/lift mechanism 16 generally includes a sleeve 28 and lift cords 30. The sleeve 28 has a first sleeve member 32 and a second sleeve member 34. If sufficiently rigid structure is used to connect the sleeve 32 to the slats, a single sleeve member could be utilized. The sleeve 28, however, preferably includes a pair of sleeve members 32,34. The sleeve members 32,34 extend from the headrail 12 to the bottom rail. The sleeve members 32,34 confront one another and are positioned along opposing external longitudinal edges 36 of each slat 14. The sleeve 28 is preferably made from flexible woven or non-woven material made tubular by adhesives or stitching. The sleeve 28 could also be made from tubular braided or tubular knit fabrics.

Figure 5:
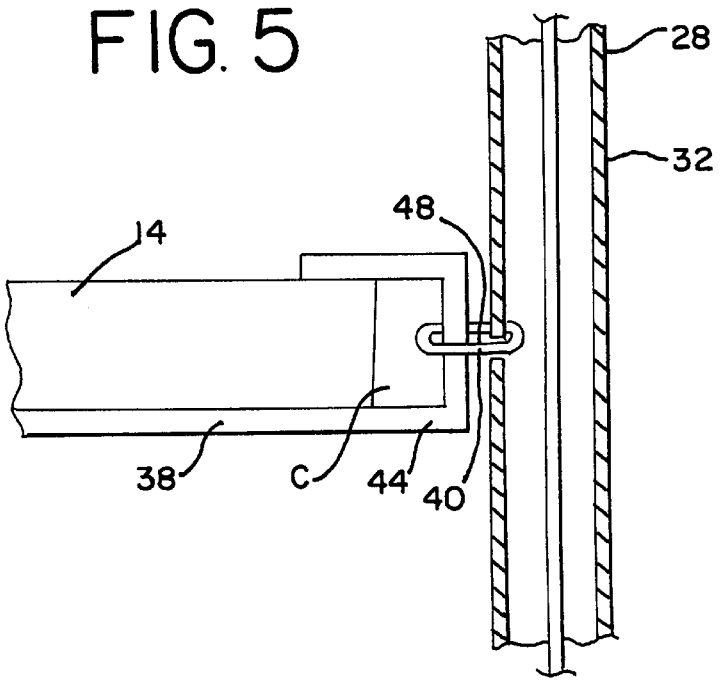

The sleeve members 32,34 are connected to each slat 14 of the blind 10 proximate the longitudinal edges 36 of the slats 14. This connection can be made in a variety of different ways. FIGS. 3 and 4 show a preferred embodiment of this connection, which includes a clip 38 and a loop 40. The clip 38 is preferably a thin, spring metal strip; it can also be constructed of plastic, rubber or other materials. The loop 40 is preferably made from high strength thread (e.g. nylon); it can also be constructed of plastic, rubber, metal or other suitable material for connection through the sleeve 28. The clip 38 engages the slat 14 and the loop 40 cooperates with the clip 38 and sleeve 28 to connect the sleeve 28 to the slat 14. Specifically, the clip 38 is attached to the slat 14 and includes a main portion 42 and a first engaging member 44 and a second engaging member 46. The main portion 42, being of a very thin cross-section (shown enlarged in FIGS. 3 and 4), is positioned along the bottom surface 37 of the slat 14. The first and second engaging members 44,46 frictionally engage, or grip, the opposing external longitudinal edges 36 of the slat 14. Specifically, in the preferred embodiment, the engaging members 44,46 grip the top and bottom surfaces 35,37 of the slat 14 at the longitudinal edges 36 of the slats 14. Some clearance C (FIG. 5) may be maintained between the engaging members 44,46 and the longitudinal edges 36 of the slat 14. As shown in FIG. 3, a first loop 40 is then positioned around the first engaging member 44 and through a pair of openings 48 in the first sleeve member 32 (a single opening being shown in FIG. 3) to connect the sleeve 28 to the slat 14. FIG. 5 is an enlarged view showing, in greater detail, the clip 38 and the loop 40 connecting the sleeve 28 to the slat 14. If desired, the loop 40 can be sewn directly to the sleeve 28. Likewise, a second loop 41 is positioned around the second engaging member 46 and through a pair of openings 48 in the second sleeve member 34. As shown in FIG. 1, these connections are made for each slat 14 along the length of the sleeve 28.

FIG. 4 shows an alternative clip 38 that can be used in the present invention. Here, the clip 38 is simply comprised of the first engaging member 44 and second engaging member 46 without the use of the main portion 42. As in FIG. 3, the first loop 40 is routed around the first engaging member 44 and through the pair of openings 48 in the first sleeve member 32. The second loop 41 is routed around the second engaging member 46 and through the pair of openings 48 in the second sleeve member 34.

The connection between the sleeve 28 and slats 14 can take other forms. For example, the loop 40,41 can be adhesively secured to the sleeve members 32,34. Also, the loop 40,41 can be formed by taking an individual strand of material from the sleeve 28. Plastic or metal washers attached to loops or directly on the tubular sleeve could also be used. In addition, the loops 40,41 can be eliminated by adhesively securing the sleeves directly to the external longitudinal edges 36 of the slats 14. A clip, such as engaging members 44,46, could be passed directly through the sleeve 28 and onto the longitudinal edges 36 of the slat, also eliminating the loop 40,41.

This connection of the tilt/lift mechanism 16 allows the plurality of slats 14 to be tilted to open and close the blind 10. As shown in FIG. 1, the end of the sleeve 28 located in the headrail 12 is connected to the tilt assembly 18. Specifically, the sleeve 28 is connected to the roller 22 supported on the shaft 20. By turning an actuating rod 25 of the gear mechanism 24, the sleeve 28 is taken up on the roller 22. Because the sleeve 28 is connected to each slat 14, the slats 14 are tilted to close the blind 10 (not shown). By turning the rod 25 in the opposite direction, the sleeve 28 is taken off of the roller 22, thus leveling the slats 14 and opening the blind 10.

Lift cords 30 are also used in the tilt/lift mechanism 16 to adjust the height of the blind 10. A lift cord 30 is utilized on each end of the blind 10. Conventionally, the lift cords 30 are connected to the bottom rail, extend upwards into the headrail 12, through the lift cord clutch 26, and then hang down from the headrail 12. As shown in FIG. 1, similar to the sleeves 28, the lift cords 30 are also positioned along the external longitudinal edges 36 of the slats 14. Preferably, a lift cord 30 is used along opposing external longitudinal edges 36 of the slats 14, on each side of the blind 10, making a total of four lift cords 30. In addition, as further shown in FIGS. 1 and 3, the lift cords 30 are positioned within the sleeves 28. Thus, a first lift cord 30 is positioned within the first sleeve member 32 and a second lift cord 30 is positioned within the second sleeve member 34. The lift cords 30 extend from the bottom rail and through openings 50 (FIGS. 1 and 2) in the headrail.

FIG. 2 shows the path of the lift cords 30 within the headrail 12. After passing through the openings 50 in the headrail 12, the lift cords 30 extend to the clutch 26 positioned proximate a front end portion of the headrail 12. The two lift cords 30*a*, 30*b* (FIG. 2) positioned at the front of the blind 10 extend directly across to the clutch 26, along an axis substantially parallel to the a longitudinal axis L of the headrail 12. The lift cords 30 pass through the clutch 26 and then hang down along the blind 10 as shown in FIG. 1. By pulling on the hanging portions of the lift cords 30, the bottom rail is evenly raised, thus stacking the plurality of slats 14 on one another from the bottom towards the headrail 12. As the blind 10 is raised, the flexible sleeves 28 fold up. If desired, the hanging portions of the lift cords 30 can be connected to a fastener (not shown) connected to a single cord so that the single cord can be pulled to raise the blind 10 rather than having to pull evenly on the four separate lift cords 30.

A number of advantages are realized with the blind 10 having the tilt/lift mechanism 16 of the present invention. First, the connection between the sleeves 28 and slats 14 eliminates the need for ladder cords, thus allowing the slats to be more fully closed. In addition, the stack height of the blind when raised to an uppermost position is minimized since there is less structure, such as ladder cords and lift cords positioned between the slats. Likewise, the clip/loop connections also minimizes the stack height of the blind 10. Also, the slats 14 can be completely closed because the lift cords 30 do not pass through the slats 14, thus maximizing privacy. In addition, light cannot pass through the slats 14 because there are no holes or other perforations in the slats 14. Because the lift cords 30 do not pass through the slats 14, the slats 14 can be easily removed for cleaning, repair or replacement by removing the slats 14 from the clips 38.

The tilt/lift mechanism 16 of the present invention also reduces the friction present in the lift cords 30 when pulling on the lift cords 30 to raise the blind 10. First, a portion of the weight of the slats 14 is held by the sleeves 28 thus reducing tension on the lift cords 30. Also, the number of lift cords 30 utilized is doubled from conventional blinds. Normally, a pair of lift cords is used that pass through the center of each slat. In the present invention, four lift cords 30 are used thus reducing tension on each cord. Finally, in conventional blinds, the lift cords extend through holes in the slats and then into the center of the headrail. The lift cords then extend at an angle to the clutch, which increases the tension present in the lift cords and increases the friction when pulling the cords through the clutch. In the present invention, the lift cords 30 enter at the front of the headrail and extend directly across to the clutch rather than at an angle. This configuration reduces the amount of friction developed when pulling the cords through the clutch. Consequently, the lift cords are easier to pull to raise the blind 10.

Figure 6:
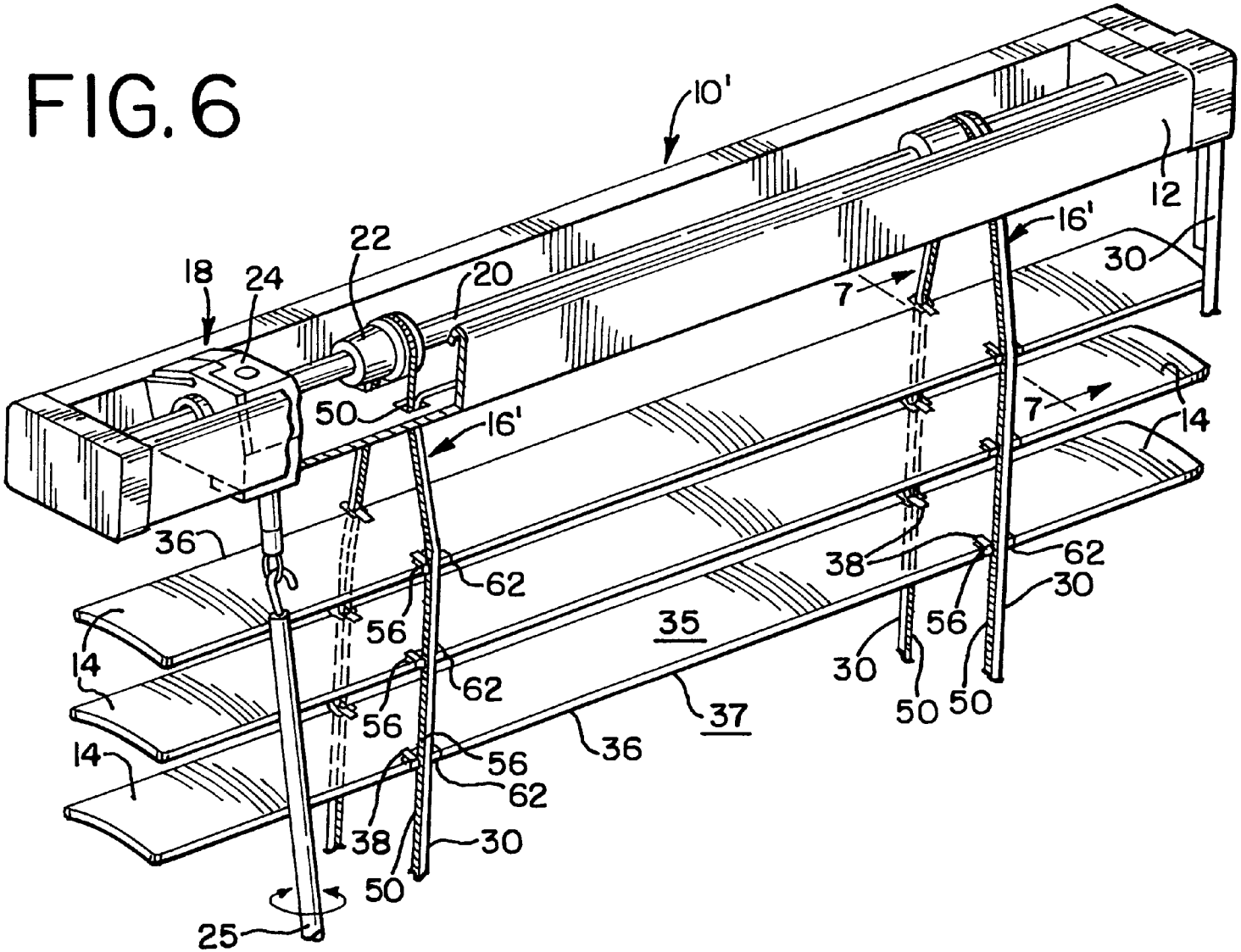
FIG. 6 is a partial perspective view of another embodiment of the window blind of the present invention.

FIGS. 6–9 show another embodiment of a holeless window blind of the present invention, generally referred to with the reference numeral 10'. Similar elements in this embodiment will be referred to with identical reference numbers as in the previous embodiment. As with the previous embodiment, this blind 10' as shown in FIG. 6 includes a headrail 12 housing a tilt assembly 18 and a plurality of slats 14 having opposed external longitudinal edges 36. In general, blind assembly 10' shares all common components with that of blind 10, however, blind 10' differs from the previous blind 10 in that it employs a modified tilt/lift mechanism 16'. As shown in FIG. 6, a pair of tilt/lift mechanisms 16' are included, one on each end of the blind 10'. As with the previous embodiment, more or less tilt/lift mechanisms 16' could be utilized depending on the size of the blind. In the preferred embodiment, however, a tilt/lift mechanism 16' is included on each end of the blind 10'.

The tilt/lift mechanism 16' of blind 10' comprises a tilt cord 50 extending from the tilt assembly 18 in the headrail 12 to a bottommost slat or bottom rail (not shown) adjacent an external longitudinal edge 36 of the slats 14 and a lift cord 30 which extends from the headrail 12 to a bottommost slat adjacent an external longitudinal edge 36 of the slats 14. The tilt cord 50 is preferably made from a flexible woven or non-woven material. The tilt cord 50 may be of solid or hollow construction, and may be constructed of any geometric shape. In the preferred embodiment, the tilt cord 50 is constructed of a solid woven nylon material. Most preferable, the woven nylon material will comprise a braided cord. Additionally, the tilt cord 50 may be attached to a fabric backing (not shown). For aesthetic purposes, the fabric backing may be positioned away from the blind (toward the user), with the tilt cord 50 positioned between the slats 14 and the fabric backing.

Additionally, the tilt/lift mechanism 16' includes a means for connecting the tilt cord 50 to each slat 14. This connection can be performed in a variety of different ways. In the preferred embodiment, shown in FIGS. 7–9, the tilt cord 50 is connected to each slat 14 of the blind 10' proximate the external longitudinal edges 36 of the slats 14 by employing a clip 38 and a tilt loop 56 for each slat 14. As before, the clip 38 can be constructed of a variety of materials including plastic or rubber, but is preferably a thin, spring metal strip. Also, the clip 38 includes a main portion 42 and a first engaging member 44 and a second engaging member 46. Some clearance C for the tilt loop 56 (shown in FIG. 9 as first tilt loop 58) may be maintained between the engaging members 44,46 and the external longitudinal edges 36 of the slat 14. The tilt loop 56 is preferably made of an integral extended portion of the braided tilt cord 50, however it can be a separate element added to the tilt cord 50. Preferably, tilt loop 56 is integrally woven into the braided tilt cord 50. The clip 38 engages the slat 14. The slat may have a notch (not shown) on one or both of the external longitudinal edges 36 for locating and seating the clip 38. The tilt loop 56 extends from the tilt cord 50 to contain the clip 38. The tilt loop 56 containing the clip 38 occurs when the tilt loop 56 is positioned around the engaging member 44,46. Thus, the engaging member 44,46 passes through the tilt loop 56.

Figure 7:
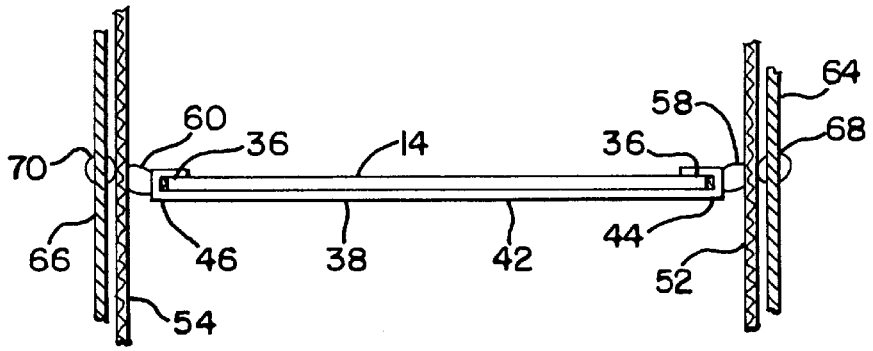
FIG. 7 is a partial cross-sectional view taken along Line 7—7 in FIG. 6 showing another embodiment of a tilt/lift mechanism of the present invention.

The tilt cord 50 includes a first tilt cord member 52 and a second tilt cord member 54. Both tilt cord members 52,54 extend from the tilt assembly 18 to the bottommost slat adjacent opposed external longitudinal edges 36 of the slats 14. As shown in FIGS. 6 and 7, the first tilt cord member 52 has a first tilt loop 58 for engaging the first engaging member 44, and the second tilt cord member 54 has a second tilt loop 60 for engaging the second engaging member 46. Thus, with first and second engaging members 44,46 engaging opposed longitudinal edges 36 of each slat 14, the first tilt loop 58 extends from the first tilt cord member 54 and cooperates with the first engaging member 44 and the second tilt loop 60 extends from the second tilt cord member 54 and cooperates with the second engaging member 46. This connects the tilt cord 50 to each slat 14.

Figure 8:
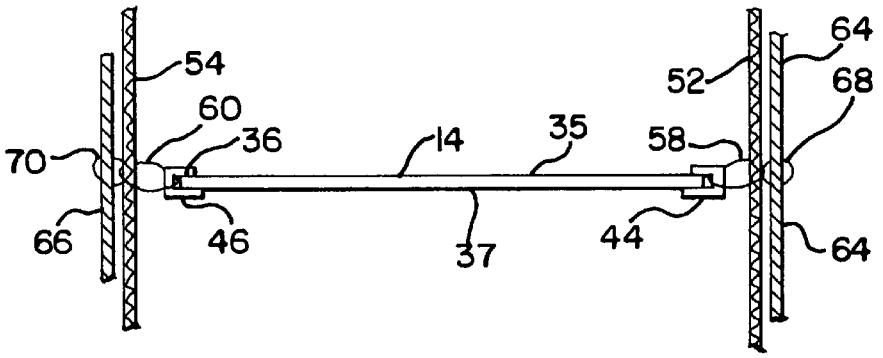
FIG. 8 is a partial cross-sectional view also taken along Line 7—7 in FIG. 6 showing an alternative embodiment of the tilt/lift mechanism shown in FIG. 7; and, FIG. 9 is an enlarged partial cross-sectional view showing a connection between a tilt cord and a slat and a lift cord of the window blind of FIG. 6.
Figure 9:
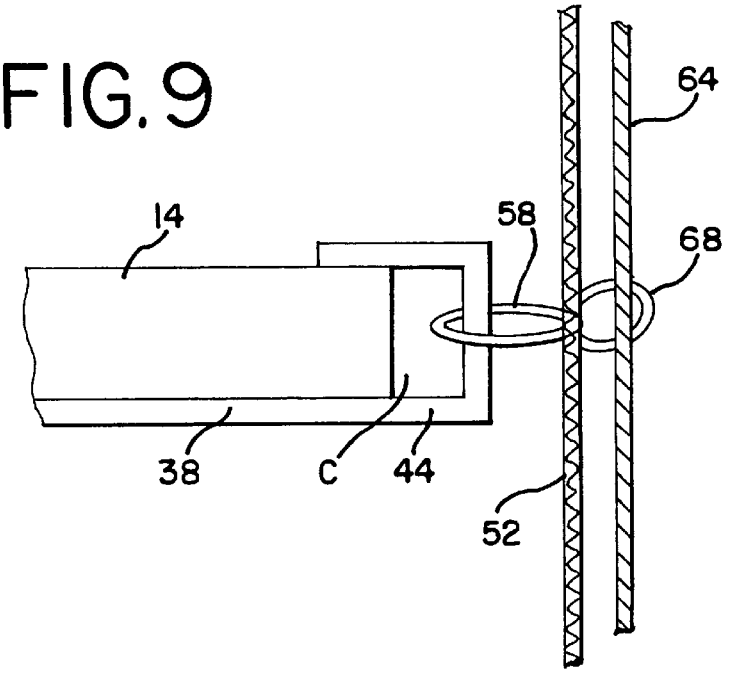

FIG. 8 discloses an alternative clip 38 that can be used with alternative embodiment blind 10'. As with the previous embodiment, the clip 38 is comprised of the first engaging member 44 and the second engaging member 46 without the use of the main portion 42. As with the embodiment in FIG. 7, the first tilt loop 58 extending from the first tilt cord member 52 is routed around the first engaging member 44. Similarly, the second tilt loop 60 extending from the second tilt cord member 54 is routed around the second engaging member 46.

Similar to the sleeve 28 of blind 10, the tilt cord 50 allows the plurality of slats 14 to be tilted to open and close the blind 10'. As shown in FIG. 6, the tilt cord 50 is connected to the roller 22 supported on the shaft 20. As the user or operator turns an actuating rod 25 of the gear mechanism 24, either the first or second tilt cord member 52,54 is taken up on the roller 22. Accordingly, the other of the first or second tilt cord member 52,54 is taken off of the roller 22. Because the tilt cord 50 is connected to each slat 14, the slats 14 are tilted to close the blind 10'. Then, by turning the rod 25 in the opposite direction, the tilt cord member 52,54 which is on the roller 22 is rolled of the roller 22 to level out the slats 14. Ultimately, by continuing to turn the rod 25 in the same direction, the slats 14 will close at approximately 180° to the above first closing position.

In this embodiment, lift cords 30 are used in the tilt/lift mechanism 16' to adjust the vertical height of the blind 10'. Preferably, a lift cord 30 is utilized on each end of the blind 10'. As shown in FIG. 6, similar to the tilt cords 50, the lift cords 30 are also positioned along the external longitudinal edges 36 of the slats 14. In the preferred embodiment, a total of four lift cords 30 are utilized, proximate the tilt cords 50, along opposing external longitudinal edges 36 of the slats 14 and on each side of the blind 10'.

Additionally, the tilt/lift mechanism 16' includes a means for connecting the lift cord 30 to the tilt cord 50. In the preferred embodiment of the present invention, the means includes a lift cord loop 62 extending from the tilt cord 50 to contain the lift cord 30. Like tilt loop 56, lift cord loop 62 is preferably made of an integral extended portion of the woven tilt cord 50. However, the lift cord loop 62 can also be made of a separate element added to the tilt cord 50. The lift cord loop 62 is generally proximate the tilt loop 56 on the tilt cord 50.

Another means for connecting the lift cord 30 to the tilt cord 50 includes the lift cord 30 being spirally wrapped around the tilt cord 50. With this means, lift cord loops 62 are not necessary. The lift cord 30 extends from the headrail 12 to the bottommost slat adjacent opposed external longitudinal edges 36 of the slats 14 as usual. But, the lift cord 30 is wrapped or wound around the tilt cord 50 in a spiral fashion. The lift cord 30 can make a complete spiral (360°) around the tilt cord 50 every slat 14, or more preferably, every other slat 14, or most preferably, after several slats 14.

The lift cord 30 can include a first lift cord member 64 and a second lift cord member 66. In the preferred embodiment, as shown in FIG. 6, both lift cord members 64,66 extend from the headrail 12 to the bottommost slat adjacent the opposed external longitudinal edges 36 of the slats 14. The end of each lift cord member 64,66 is then fixed to the bottommost rail. And, as with the tilt loop 56, there exists a first lift cord loop 68 proximate the first tilt loop 58 on the first tilt cord member 52, and a second lift cord loop 70 proximate the second tilt loop 60 on the second tilt cord member 54. In this situation, the first lift cord member 64 is contained by the first tilt cord member 52 through the first lift cord loop 68 and the second lift cord member 66 is contained by the second tilt cord member 54 through the second lift cord loop 70.

The connection between the tilt cord 50 and the slats 14 and the lift cord 30 can take a variety of additional forms. For example, the loops 58,60,68,70 can be adhesively secured to the tilt cord 50. Also, plastic, rubber or metal washers attached to the loops or directly onto the tilt cord 50 could also be used. In addition, the first and second tilt loops 58,60 can be eliminated by fixedly securing the tilt cord members 52,54 directly to either the external longitudinal edges 36 of the slats 14 or to the engaging members 44,46.

As with the first embodiment 10, this blind 10' utilizes the same lift cord 30 path within the headrail 12 as shown in FIG. 2, and realizes the same advantages as described above, including decreased stack height and better closure of the blind assembly. Thus, as the bottom rail is raised, stacking the plurality of salts 14 on one another, the flexible tilt cords 50 connected to the slats 14 through the tilt loops 56 also stack up in a folded manner. Similarly, the lift cord 30 itself stacks up in a folded manner like the tilt cord 50 since the lift cord 30 is contained to the tilt cord 50 by the lift cord loop 62. As above, the hanging portions of the lift cords 30 can be connected to a fastener (not shown) connected to a single cord so that the single cord can be pulled to raise the blind 10' rather than having to pull evenly on the four separate lift cords 30.

While the specific embodiments have been illustrated and described, numerous modifications come to mind without significantly departing from the spirit of the invention and the scope of protection is only limited by the scope of the accompanying claims.

I claim:

1. A window blind having a headrail, housing a tilt assembly, and a plurality of slats, the slats further having opposed external longitudinal edges, the blind comprising:

a tilt cord extending from the tilt assembly to a bottommost slat adjacent an external longitudinal edge of the slats;

a lift cord extending from the headrail to a bottommost slat adjacent an external longitudinal edge of the slats;

a clip for each slat, the clip engaging and overlapping the external longitudinal edge of the slat;

a means for connecting the tilt cord to the clip; and, a means for connecting the lift cord to the tilt cord.

2. The blind of claim 1 wherein the means for connecting the tilt cord to each slat includes a tilt loop for each slat, the tilt loop extending from the tilt cord and cooperating with the clip.

3. The blind of claim 1 wherein the means for connecting the lift cord to the tilt cord includes a lift cord loop extending from the tilt cord to contain the lift cord.

4. The blind of claim 1 wherein the tilt cord includes a first tilt cord member and a second tilt cord member, both tilt cord members extending from the tilt assembly to the bottommost slat adjacent opposed external longitudinal edges of the slats.

5. The blind of claim 4 wherein the means for connecting the tilt cord to each slat includes a clip and first and second tilt loops for each slat, the clip having first and second engaging members engaging the opposed longitudinal edges of each slat, the first tilt loop extending from the first tilt cord member and cooperating with the first engaging member and the second tilt loop extending from the second tilt cord member and cooperating with the second engaging member.

6. The blind of claim 4 wherein the lift cord includes a first lift cord member contained by the first tilt cord member and a second lift cord member contained by the second tilt cord member.

7. The blind of claim 6 wherein the means for connecting the lift cord to the tilt cord includes first and second lift cord loops, the first lift cord loop extending from the first tilt cord member to contain the first lift cord member and the second lift cord loop extending from the second tilt cord member to contain the second lift cord member.

8. The blind of claim 1 wherein each slat is a solid member having no holes.

9. The blind of claim 1 wherein the slats are individually removable from the blind.

10. The blind of claim 1 wherein the headrail houses a clutch positioned proximate a front of the headrail, the lift cord entering a front portion of the headrail wherein the lift cord extends to the clutch along an axis substantially parallel to a longitudinal axis of the headrail.

11. A window blind having a headrail, housing a tilt assembly, and a plurality of slats, the slats further having opposed external longitudinal edges, the blind comprising:

a tilt cord extending from the tilt assembly to a bottommost slat adjacent an external longitudinal edge of the slats;

a lift cord extending from the headrail to a bottommost slat adjacent an external longitudinal edge of the slats;

a clip for each slat, each clip engaging and overlapping the external longitudinal edge of the slat;

a tilt loop extending from the tilt cord and cooperating with the clip; and, a lift cord loop extending from the tilt cord to contain the lift cord.

12. The blind of claim 11 wherein the clip engages the external longitudinal edge of the slat at opposing top and bottom surfaces of the slat.

13. The blind of claim 11 wherein the tilt loop is positioned around the clip.

14. The blind of claim 11 wherein each slat is a solid member having no holes.

15. The blind assembly of claim 11 wherein the slats are individually removable from the blind.

16. A window blind including a headrail, housing a tilt assembly, and a plurality of slats, the slats further having opposed external longitudinal edges, the blind comprising:

a first tilt cord member and a second tilt cord member, both tilt cord members extending from the tilt assembly to a bottommost slat adjacent opposed external longitudinal edges of the slats;

a clip for each slat, the clip having first and second engaging members engaging the opposed external longitudinal edges of each slat at the top and bottom surfaces of the slats;

first and second tilt loops, the first tilt loop extending from the first tilt cord member and cooperating with the first engaging member and the second tilt loop extending from the second tilt cord member and cooperating with the second engaging member; and, a first and second lift cord member and a first and second lift cord loop, the first lift cord loop extending from the first tilt cord member to contain the first lift cord member and the second lift cord loop extending from the second tilt cord member to contain the second lift cord member, each lift cord member extending from the headrail to the bottommost slat adjacent external longitudinal edges of the slats wherein each lift cord member is attached to the bottommost slat.

* * * * *